US006357709B1

(12) United States Patent
Parduhn

(10) Patent No.: US 6,357,709 B1
(45) Date of Patent: Mar. 19, 2002

(54) BRACKET ASSEMBLY WITH SPLIT CLAMP MEMBER

(76) Inventor: A. Philip Parduhn, 14501 Wilson Rd., Edmond, OK (US) 73013

( * ) Notice: Subject to any disclaimer, the term of this patent is extended or adjusted under 35 U.S.C. 154(b) by 0 days.

(21) Appl. No.: 09/338,910

(22) Filed: Jun. 23, 1999

(51) Int. Cl.[7] ..... G09F 7/18
(52) U.S. Cl. ..... 248/229.17; 248/214; 248/230.5
(58) Field of Search ..... 248/229.17, 163.1, 248/187.1, 229.1, 205.1, 230.5, 214

(56) References Cited

U.S. PATENT DOCUMENTS

| | | | | |
|---|---|---|---|---|
| 1,682,693 | A | | 9/1928 | Day |
| 1,985,951 | A | | 1/1935 | Richterkessing |
| 2,038,117 | A | | 4/1936 | Layton |
| 2,124,006 | A | | 7/1938 | Parker |
| 2,498,590 | A | | 2/1950 | Straus |
| 2,942,366 | A | | 6/1960 | Pfaff et al. |
| 3,142,501 | A | | 7/1964 | Clark et al. |
| 3,586,280 | A | | 6/1971 | Parduhn |
| 3,764,099 | A | | 10/1973 | Parduhn |
| 3,854,685 | A | | 12/1974 | Parduhn |
| 3,888,446 | A | | 6/1975 | O'Brien et al. |
| 3,917,205 | A | | 11/1975 | Meadors |
| 4,101,191 | A | | 7/1978 | Gould et al. |
| 4,142,173 | A | | 2/1979 | Gould et al. |
| 4,148,456 | A | | 4/1979 | Garchinsky |
| 4,167,033 | A | | 9/1979 | Fletcher |
| 4,447,750 | A | | 5/1984 | Howlett et al. |
| 4,460,142 | A | | 7/1984 | O'Rorke |
| 4,489,910 | A | | 12/1984 | Ferguson |
| 4,659,046 | A | | 4/1987 | Parduhn |
| 4,860,985 | A | | 8/1989 | Olsen et al. |
| 4,917,338 | A | | 4/1990 | Olson et al. |
| 5,069,416 | A | | 12/1991 | Ennis |
| 5,105,350 | A | | 4/1992 | Tolman et al. |
| 5,299,773 | A | | 4/1994 | Bertrand |
| 5,340,069 | A | | 8/1994 | Niemeyer |
| 5,645,255 | A | | 7/1997 | Parduhn |
| 5,865,406 | A | * | 2/1999 | Teeple ..... 248/163.1 |

OTHER PUBLICATIONS

"Adjustable Mast Arm Hanger," (1 page) published in the U.S. by Kentron, Inc. of Huntsville (and Houston), Texas, prior to Jun. 23, 1999.

* cited by examiner

*Primary Examiner*—Anita King
*Assistant Examiner*—Korie H. Chan
(74) *Attorney, Agent, or Firm*—Mary M. Lee

(57) ABSTRACT

A bracket assembly to support a traffic control device or other object on a mast arm or other support. The bracket assembly generally includes male and female tubular members. The female tubular member is split longitudinally, and clamped around the male tubular member by means of bolts or the like. The two halves of the split female member are identically formed, which simplifies manufacturing as only one mold is required. Further, each of the female member halves is provided with attachment means for using either cable or steel band to mount the bracket to the mast arm. Each half of the female member has a notch or pawl to which the band/cable screw assembly is inserted. When the two identical halves are placed around the male tubular member, the paw is on opposite sides of the anchor plate. In this way, the tension on half is exerted in a direction opposite to the tension on the other half. Still further, because the female member is clamped around the male member, rather than the male member being inserted in female member telescopically, no separate parts are required to axially secure the connection. Instead, in the preferred embodiment, a shoulder integrally formed in the female member engages a flange integrally formed on the end of the male member. Thus, installation is simplified; there are no small set screws or snap rings to manipulate.

65 Claims, 6 Drawing Sheets

BRACKET ASSEMBLY WITH SPLIT CLAMP MEMBER

FIELD OF THE INVENTION

The present invention relates to brackets for mounting traffic control devices and other objects to mast arms and other support members.

BACKGROUND OF THE INVENTION

Traffic lights and other traffic control devices are mounted on a variety of supports, including mast arms, of varying diameters and orientations. Mounting brackets for traffic control devices should be sturdy, adjustable and simple to install. One such bracket is the ASTRO-BRAC brand described in U.S. Pat. No. 4,659,046, which is incorporated herein by reference. The ASTRO-BRAC® bracket (Pelco Products, Inc. of Edmond, Okla. comprises a male tubular member telescopically received within a female tubular member and secured therein by a snap ring. The bracket is attached to the mast arm by an anchor plate and steel bands or cable. The bracket is attached to the traffic control device by a clamp plate and U-bolts. While the ASTRO-BRAC® bracket provides strength and versatility, there remains a need for improvements to reduce the cost of manufacturing, to simplify installation and to increase stability of the installed bracket assembly.

BRIEF SUMMARY OF THE INVENTION

The present invention is directed to a bracket assembly for supporting a traffic control device on a support member. The bracket assembly comprises a male member having a tubular portion and a connecting portion. The connecting portion is connectable to either the traffic control device or the support member. The male member defines a throughbore extending through the tubular portion and the connecting portion. The bracket assembly further includes a female member having a tubular portion and a connecting portion. The connecting portion is connectable to the other one of the traffic control device or the support member. The female member defines a throughbore extending through the connecting portion and the tubular portion. Further, the female member is divided longitudinally to form a pair of mating halves connectable to each other. The tubular portions of the mating halves are sized to clamp around the tubular portion of the male member.

In another aspect, the bracket assembly of the present invention comprises a first member having a tubular portion defining a throughbore. Means, having a throughbore, is included in the bracket assembly for removably and adjustably connecting the bracket assembly to the traffic control device. Also included is a second member having a tubular portion defining a throughbore. The second member is divided longitudinally to form a pair of mating halves connectable to each other, and the tubular portions of the mating halves are sized to clamp around the tubular portion of the first member. Also included is means, having a throughbore, for removably and adjustably connecting the bracket assembly to the support member. The throughbores of the tubular portions of the first and second members are aligned with the throughbores of the support member connecting means and the traffic control device connecting means.

In yet another aspect, the present invention comprises a bracket assembly for supporting a traffic control device on a mast arm. The bracket assembly includes a male member comprising a tubular portion with a front end and rear end and defining a throughbore. A female member is included, and it has a tubular portion with a rear end and also defines a throughbore. The female member is divided longitudinally to form a pair of mating halves connectable to each other. The tubular portions of the mating halves are sized to clamp around the tubular portion of the male member. The bracket assembly further comprises a clamp plate having a throughbore, and a connector assembly for removably and adjustably connecting the clamp plate to the traffic control device. The bracket assembly also is provided with an anchor plate having a throughbore, and a connector assembly for removably and adjustably connecting the anchor plate to the mast arm. The throughbores of the male and female members, the clamp plate and the anchor plate all are coaxially aligned when assembled.

Still further, the present invention includes a bracket assembly for supporting a traffic control device on a support member, wherein the bracket assembly comprises first and second members each having a coupling portion defining a wiring passageway therethrough. The coupling portion of the second member is divided longitudinally to form at least two sections connectable to each other, wherein the at least two sections of the coupling portion are sized to clamp around the coupling portion of the first member. The bracket assembly also includes first and second connectors, each having a wiring passageway therethrough. The first connector connects the bracket assembly to the support member. The second connector connects the bracket assembly to the traffic control device. The wiring passageways of the coupling portions of the first and second members communicate with the wiring passageways of the first and second connectors to form a continuous wiring path through the bracket assembly.

In yet another aspect, the invention is directed to a bracket assembly for supporting an object on a support member. The bracket assembly comprises a first member having a coupling portion defining a passageway extending therethrough, and a second member having a coupling portion defining a passageway therethrough. The coupling portion of the second member is divided longitudinally to form at least two sections connectable to each other, these two sections being sized to clamp around the coupling portion of the first member. A first connector, having a passageway therethrough, is included for connecting the bracket assembly to the support member. A second connector, having a passageway therethrough, is provided for connecting the bracket assembly to the object. The passageways of the coupling portions of the first and second members communicate with the passageways of the first and second connectors to form a continuous passageway through the bracket assembly.

DETAILED DESCRIPTION OF THE INVENTION

Figure 1:
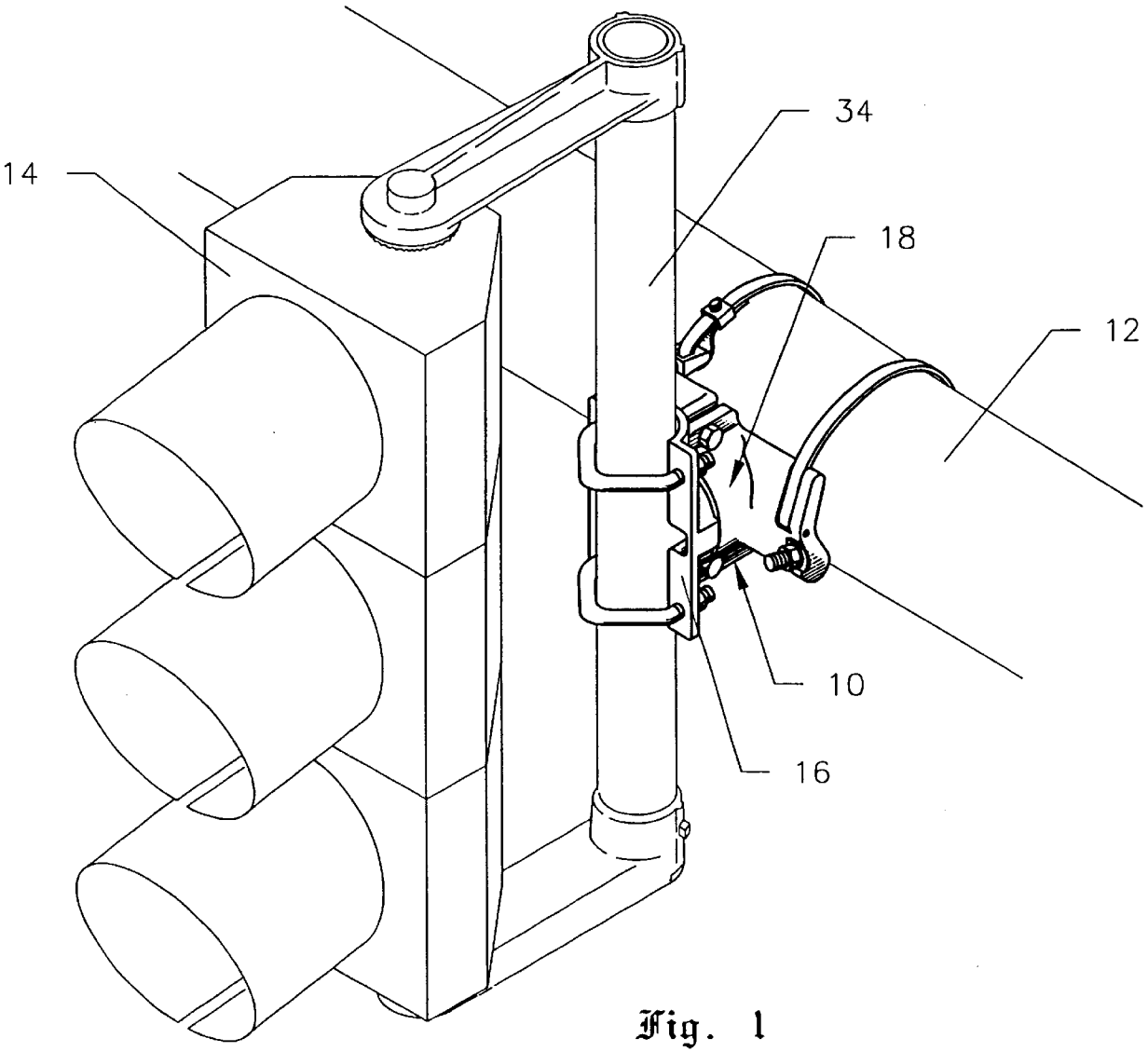
FIG. 1 is a right frontal perspective view of the bracket assembly of the present invention shown attached to a mast arm and supporting a three light traffic signal.

Turning now to the drawings in general and to FIG. 1 in particular, there is shown therein a bracket assembly constructed in accordance with the present invention and designated generally by the reference numeral 10. The bracket assembly 10 is shown in FIG. 1 attached to a mast arm 12 and supporting a three light vertical traffic signal 14. However, this bracket assembly can be used to support a wide variety of traffic control devices and other objects, and can be attached to support members other than mast arms, both horizontal and vertical. As used herein, "traffic control device" refers to any signal, sign or device supported by or over or near a roadway for affecting vehicular or pedestrian traffic, or both. This includes traffic signals and signs for controlling the direction and flow of automotive and railroad vehicles and pedestrian traffic, as well as warning devices, such as lights, signs and horns for all forms of vehicular and pedestrian traffic, such as railroad crossing signals.

Figure 2:
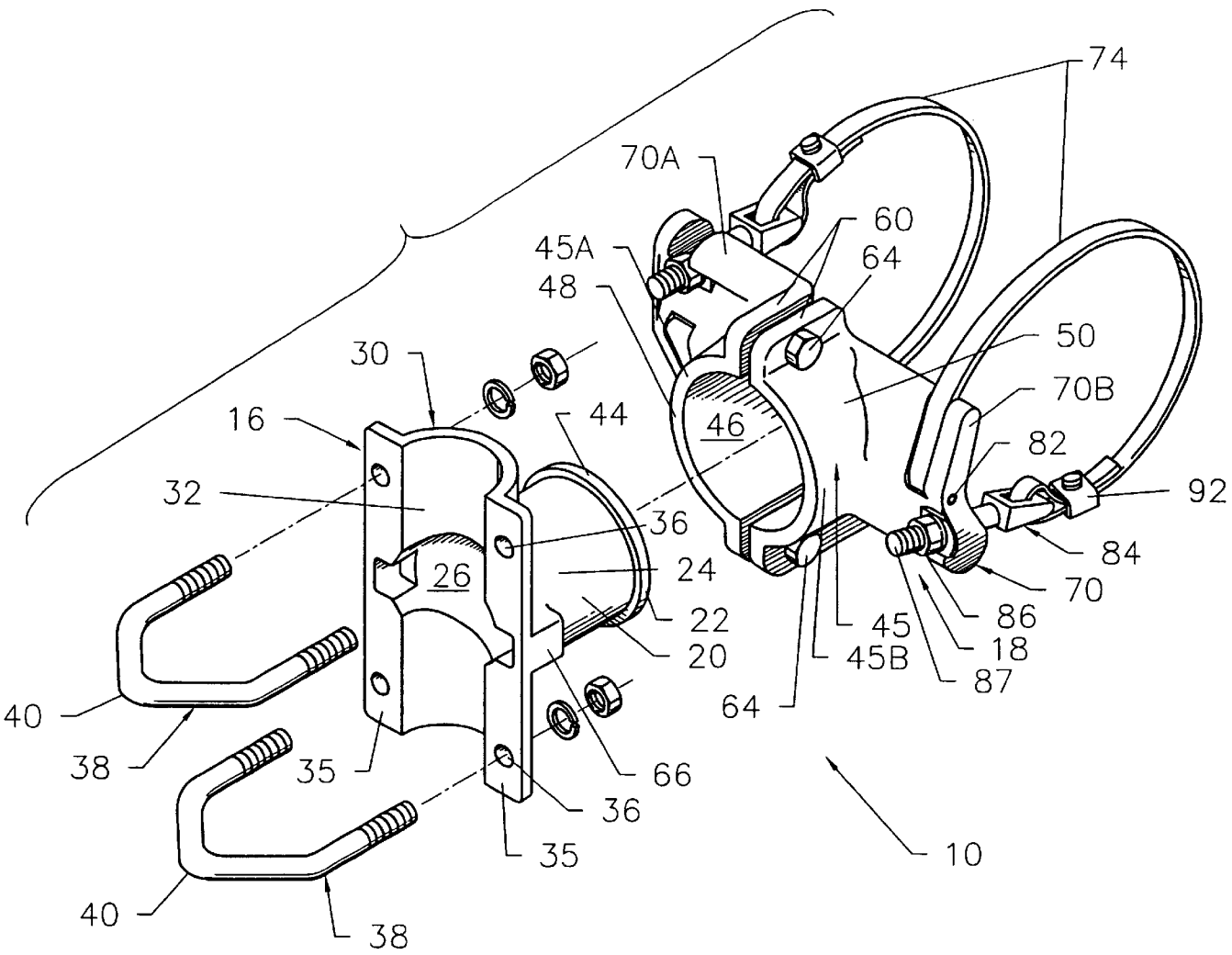
FIG. 2 is a right frontal perspective, partially exploded view of the bracket assembly shown in FIG 1.
Figure 3:
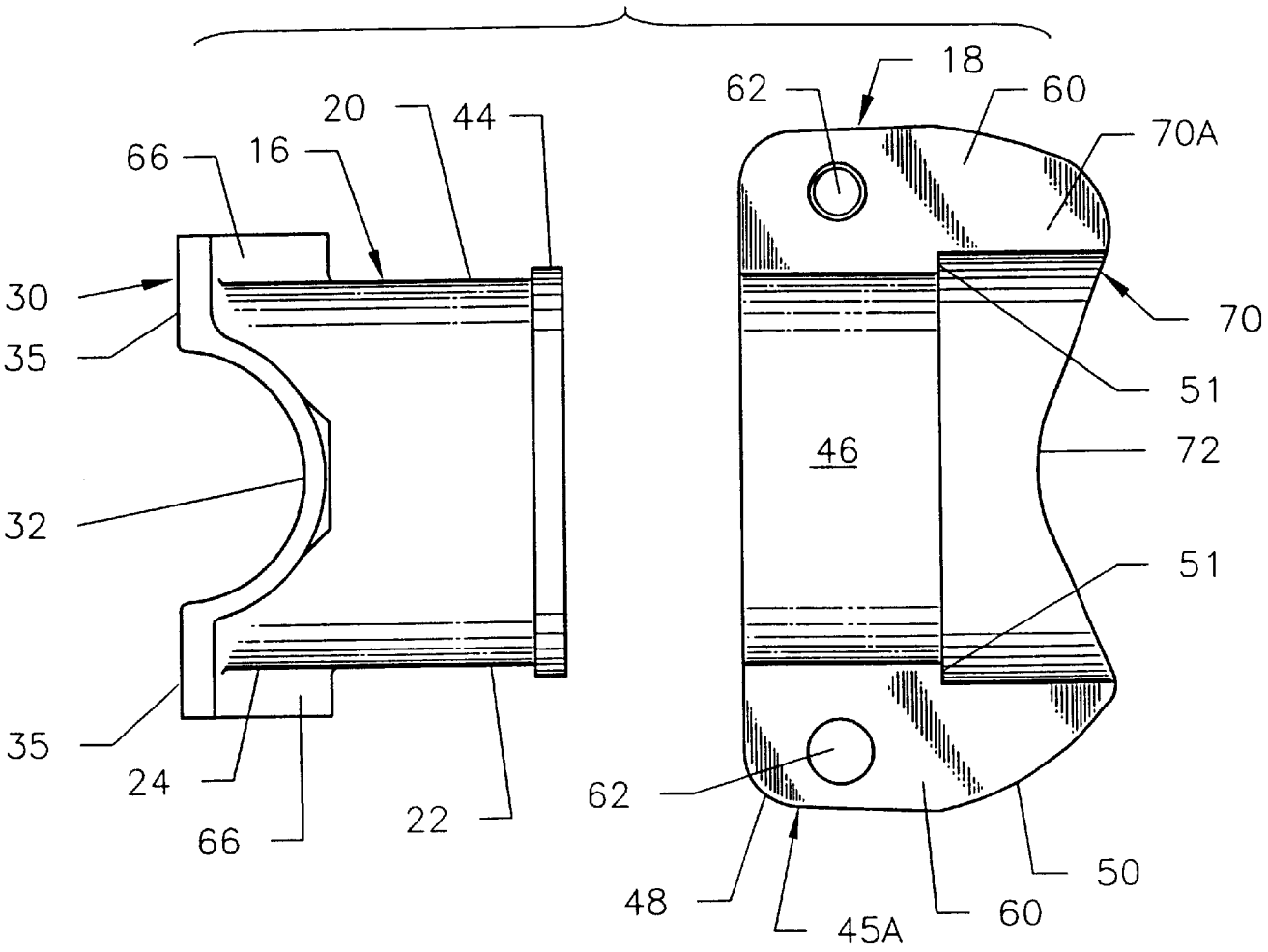
FIG. 3 is a side elevational, exploded view of the male and female members of the assembly.

Referring now also to FIGS. 2 and 3, the bracket assembly 10 comprises a first male member 16 and a second female member 18. The male member 16 comprises a coupling portion such as the tubular portion 20 with a front end 22 and a rear end 24. The tubular portion 20 defines a passageway therethrough for containing the wiring associated with the traffic control device, such as the throughbore 26. The male member further comprises a connecting portion for connecting the bracket assembly to either a support member, such as a mast arm, or to an object such a traffic control device or traffic signal 14 (FIG. 1). Preferably, this connection is removable or adjustable, and more preferably this connection is both removable and adjustable. A preferred connecting portion takes the form of a clamp plate 30 for connecting the bracket assembly to the traffic signal 14. However the connecting portion could take other forms. For example, the connecting portion could be configured to telescopically, slidably, hingedly, or threadedly engage the object or support member.

As best seen in FIGS. 2 and 3, the clamp plate 30 is provided with an arcuate channel 32 transverse to the longitudinal axis of the throughbore 26, and the throughbore extends through the clamp plate 30. While in the preferred embodiment, the arcuate channel 32 is transverse to the throughbore 26, the arcuate channel can be oriented other than transversely. The arcuate channel 32 is shaped to receive the elongate member 34 of the traffic signal 14 (FIG. 1). However, the size and configuration of the clamp plate 30 will be modified depending on the size and shape of the member to which it is to be attached. On either side of the arcuate channel 32, flanges 35 extend laterally. The flanges 35 have at least one and preferably two bolt holes 36 which receive the ends of U-bolts 38, or other connector assembly for removably and adjustably connecting the clamp plate 30 to the traffic signal 14. As shown in the drawings, the preferred U-bolt 38 has a V-shaped back portion 40, as this enhances the fit of the bolt on different diameter structures. Thus, by means of the clamp plate 30 and the cooperating U-bolts 38, the bracket assembly 10 can be removably and adjustably connected to the traffic signal 14.

Now it will be understood that while a clamp plate and bolts have been used in the preferred embodiment of this invention, other connecting portions and connecting assemblies may be substituted for these. For example, the configuration of the connecting portion can vary depending on the means by which it is affixed to the traffic control device or support member. The clamp plate could be attached by steel straps or cables instead of bolts, or it could be affixed directly by bolts, welding, gluing or the like. Similarly, the connecting portion need not be plate-like in configuration, but could take other forms. For example, the connecting portion could be configured to telescopically, slidably, hingedly, or threadedly engage the object or support member.

Referring still to FIGS. 2 and 3, the front end 22 of the tubular portion 20 of the male member 16 is provided with an annular flange 44, for a purpose yet to be described.

The female member 18 of the bracket assembly 10 comprises a coupling portion such as the tubular portion 45 that defines a wiring passageway therethrough, such as the throughbore 46. The tubular portion has a front end 48 and a rear end 50. An annular shoulder 51 (FIG. 3) is formed inside the tubular portion at the rear end 50, for a purpose that will become apparent.

The female member 18 is divided longitudinally to form a pair of mating halves connectable to each other. Thus, the halves 45A and 45B together define the tubular portion 45 and the connecting portion, described hereafter. The tubular portions 45A and 45B are sized to clamp around the tubular portion 20 of the male member 16.

The male and female members have been described herein as being tubular and as having throughbores. These terms should not be construed as limiting the members to any specific shape such as round. Rather, the male and female members could have other shapes such as square, hexagonal, octagonal and the like, so long as the male member is receivable in the female member.

Neither is it essential that the wiring passageways be axially aligned or transversely centered. Rather, any passageway that extends end to end and will house the wiring for the traffic devices involved will suffice.

To connect the halves 45A and 45B, the halves may be provided with flanges 60 with aligned bolt holes 62 therein for receiving at least one and preferably two bolts 64. In this way, the throughbores 26 and 46 of the male and female members 16 and 18 and the throughbores of their respective connecting portions are all coaxially aligned, which is preferable. It will be appreciated, though, that depending on the shape of the bracket the wiring passageways need not be linearly arranged, so long as the wiring passageways of the coupling portions and connecting portions form a continuous wiring path through the bracket assembly.

In the preferred embodiment, the bracket assembly 10 comprises an axial stop for retaining the tubular portion 20 of the male member 16 inside the tubular portion 45 of the female member 18 when the tubular portion of the female member is clamped around the tubular portion of the male member. Now it will be appreciated that the previously described annular flange 44 on the front end 22 of the male member tubular portion 20 and the annular shoulder 51 on the rear end 50 of the female member tubular portion 45 serve this purpose. More specifically, and as best seen in FIG. 3, the annular flange 44 will engage the annular shoulder 51 when the bracket assembly is assembled, so that displacement of the male member 16 from the female member 18 is prevented. It may also be desirable to form ears 66 on the male member tubular portion 20 to limit axial movement of the female member 18 on the end opposite the flange 44 and shoulder 51.

The cooperating flange and shoulder integrally formed on the inside of the bracket assembly is a preferred type of axial stop as it simplifies both manufacture of the assembly and installation by the customer. Nevertheless, there exist various other ways of securing the male member axially relative to the female member when the female member clamped around the male member. For example, a circumferential groove may be substituted for the flange on the front end of the male tubular portion. In this embodiment of the bracket assembly, then, there is included a snap ring sized to fit in the groove and to engage the annular shoulder when the female tubular member is clamped around the tubular portion of the male member. Thus, the snap ring secures the axial position of the male and female members. This arrangement is described in detail in my earlier patent, U.S. Pat. No. 4,659,046, entitled "Traffic Control Device Mast Arm Bracket," issued Apr. 21, 1987, the content of which is incorporated herein by reference.

Still further, one or more stop screws may be employed. This is accomplished by forming screw holes through the front end of the male tubular member for receiving stop screws. In this way, the expanded heads of the stop screws engage the annular shoulder of the rear end of the female tubular member to prevent axial dislodgement. This stop screw arrangement is described in detail in U.S. Pat. No. 5,340,069, entitled "Bracket for Traffic Control Device," issued Aug. 23, 1994, the content of which is incorporated herein by reference.

The female member 18 of the bracket assembly 10 further comprises a connecting portion that is divided longitudinally into halves corresponding to the halves 45A and 45B of the tubular portion 45. The connection portion is connectable to either a support member, such as the mast arm 12, or a traffic control device, such as the traffic signal 14 (See FIG. 1). Preferably, this connection is removable or adjustable, and more preferably this connection is both removable and adjustable. It will be apparent that the connecting portion of the female member should be adapted to connect to the traffic control device if the male member connects to the mast arm, and to the mast arm if the male member connects to the traffic control device.

Figure 4:
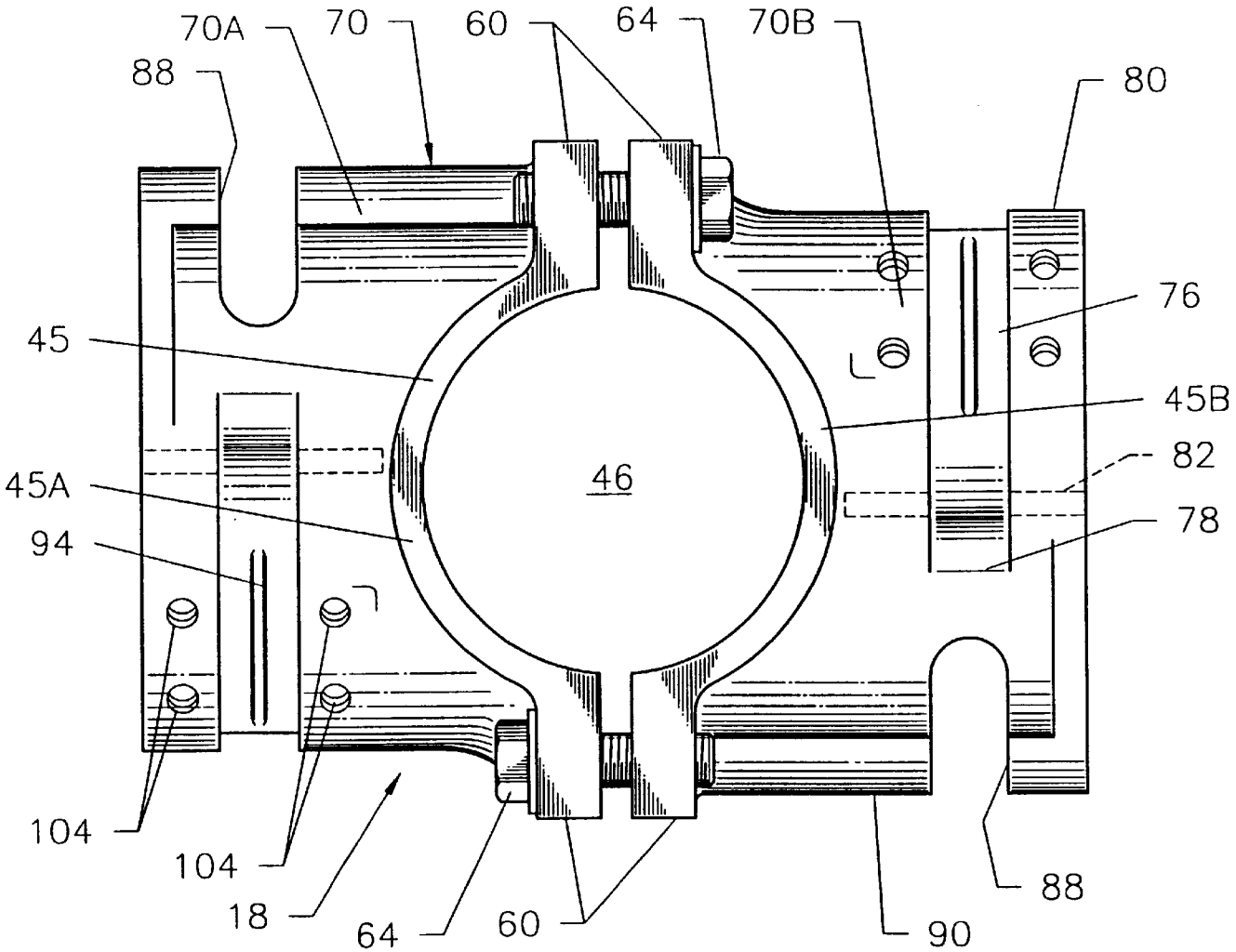
FIG. 4 is a front elevational view of the split clamp member of the bracket assembly with the bands and screw assemblies removed to illustrate the identical configuration of the two halves.
Figure 5:
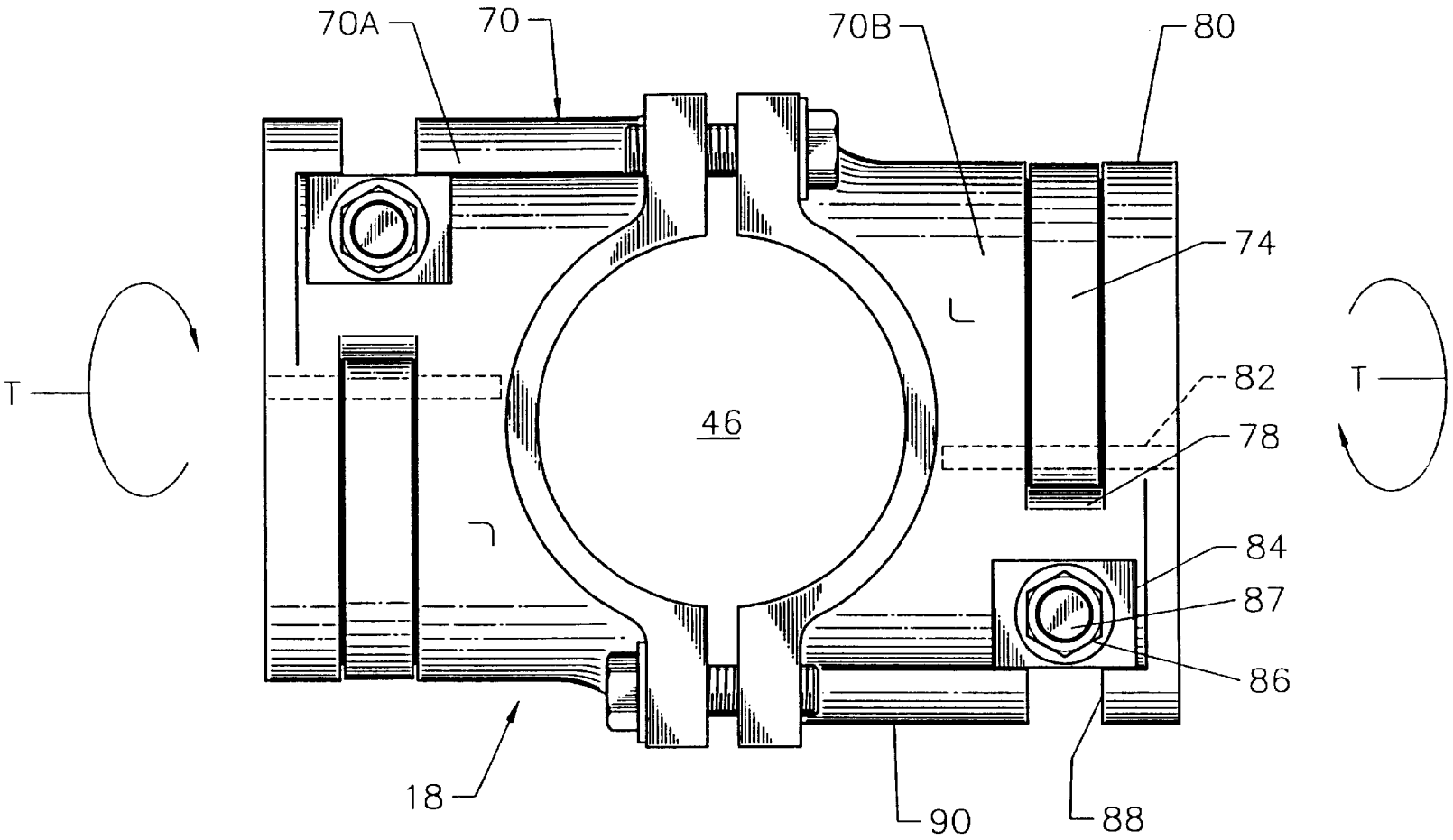
FIG. 5 is a front elevational view of the split clamp member of the bracket assembly showing attachment of the anchor plate by steel bands.
Figure 6:
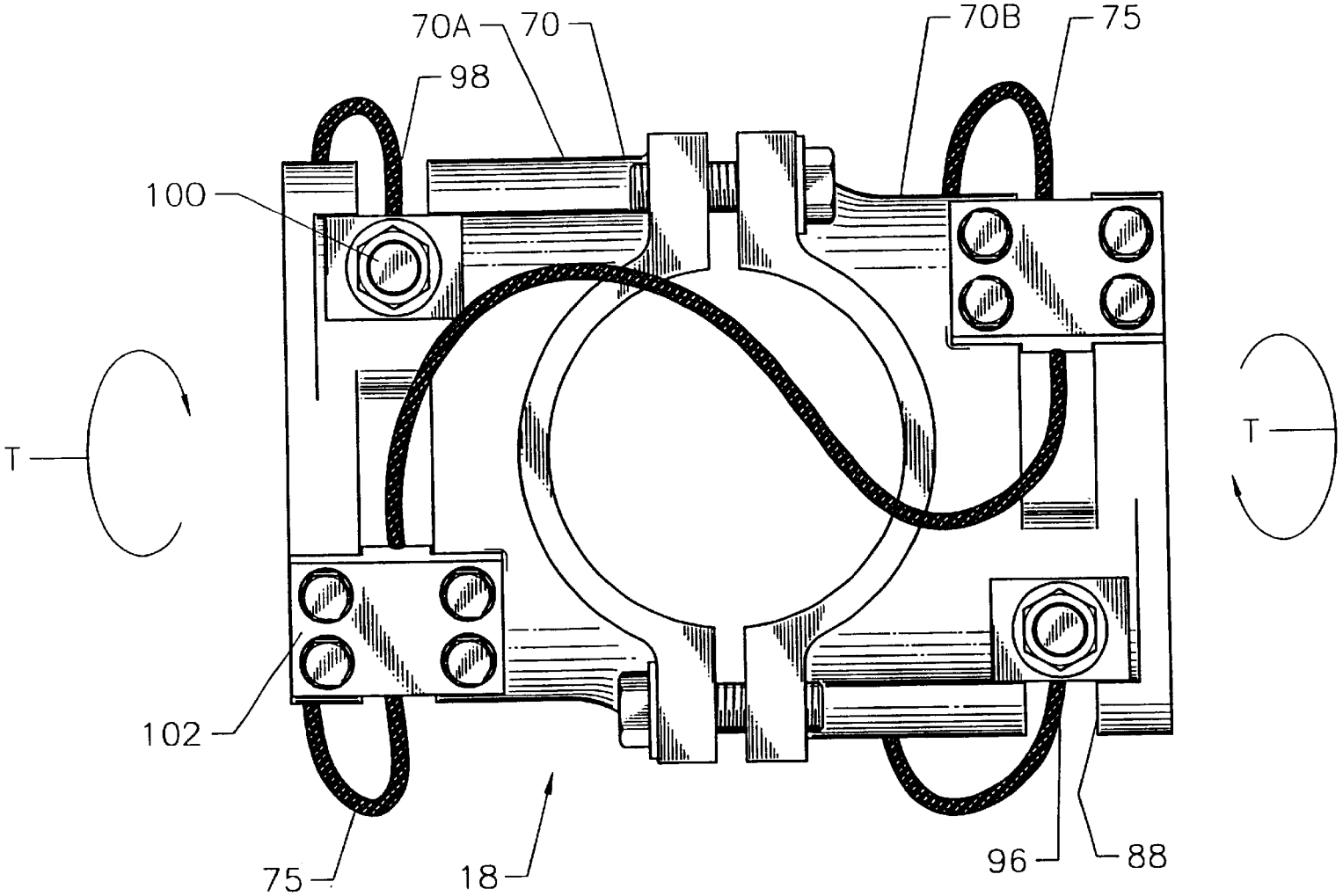
FIG. 6 is a front elevational view of the split clamp member showing attachment of the anchor plate by a cable.

As illustrated in FIG. 2, and also in FIGS. 4, 5 and 6, the connecting portion of the female member 18 preferably takes the form of an anchor plate 70 formed by the two halves 70A and 70B which are connectable to the mast arm 12 (See FIG. 1). The anchor plates 70A and 70B are provided with a channel 72 (FIG. 3) sized to receive the mast arm 12 (or other structure). As with the clamp plate 30, the anchor plate 70 can be replaced with any other sort of connecting portion. For example, the connecting portion could be configured to telescopically, slidably, hingedly, or threadedly engage the object or support member.

Turning briefly to FIGS. 1 and 5, the preferred anchor plate 70 in this invention is adapted for use with elongate connectors, such as flexible steel bands 74. Alternately, the anchor plate 70 may be adapted for use with a cable type connector, most likely a single length of cable 75, as shown in FIG. 6. Even more preferably, the anchor plate 70 is adapted for connection to a band and alternately to a cable. This allows manufacture of only one style anchor plate, which then can be assembled for shipment with either a cable mounting assembly or a band mounting assembly, depending on the customer's request.

As best seen in FIGS. 4 and 5, the two halves of the split female member 18 preferably are identically formed. Because the halves 70A and 70B of the anchor plate 70 are identically formed, only the half 70B will be described in detail.

The anchor plate 70B is characterized by at least a first track 76 sized to receive and align a portion of the band 74, which is disposable in the track. The track 76 preferably begins at a blind end 78 near the middle of the anchor plate 70B and extends over the top edge 80 thereof. One end of the band 74 is looped and attached at the blind end 78 of the track 76 with a pin 82 (FIG. 2). The other end of the band 74 is left free until the bracket assembly is installed. At the time of installation, the free end is attached to the anchor plate 70B by means of a connector attachment/adjustment assembly, such as the screw assembly 84 (FIGS. 2 and 5).

Referring still to FIGS. 2 and 5, the preferred screw assembly 84 includes a nut 86 which pulls the threaded end of the screw 87 up through through an aperture, such as the notch or pawl 88 in the bottom edge 90 of the anchor plate 70B. The free end of the band 74 is attached to the lower end of the screw assembly 84 by some means such as a band buckle 92, for example. Then, the nut 86 is threaded further, pulling the screw 87 up through the pawl 88 until the band 84 is tightened sufficiently around the mast arm 12 (FIG. 1). The band on the other side of the anchor plate 70A is similarly assembled and tightened.

Now a particularly advantageous feature of this embodiment of the invention will be appreciated. Because the two halves 70A and 70B are identically formed, the tension or torque on the anchor plate 70B, while it is being tightened on the mast arm 12, is in a direction opposite to the tension or torque of the anchor plate 70A, while it is being tightened. The directions of tension are illustrated by the arrows "T" in FIG. 5. This provides a sturdy and durable connection.

As illustrated in FIG. 6, to which attention now is directed, the anchor plates 70A and 70B alternately can be secured to the mast arm 12 (FIG. 1) by means of a cable using a screw assembly similar to that described for use with the bands 74. Returning to FIG. 4, the anchor plate 70A (and, of course, the anchor plate 70B, although it will not be described in detail) preferably is modified to include a second track comprising a small, radiused groove 94 shaped to receive and align a portion of the cable 75, which is disposable therein.

While it is not essential to the invention, it is most desirable to utilize a cable which is long enough to have one end 96 attached to one half of the anchor plate 70A and the other end 98 attached to the other half of the anchor plate 70B. In this arrangement, a screw assembly 100 is provided for each end 96 and 98 of the cable 75. The ends 96 and 98 of the cable 75 are attached to the screw assembly 100 in some suitable manner (not shown). Then the screws are placed in the pawl 88 and the nuts are tightened to secure the anchor plate 70 on the mast arm 12 in a manner similar to that described above.

When the elongate connector is a cable, such as the cable 75, it is advantageous to include in the assembly a set of plates and screws, designated generally by the numeral 102 for securing the cable in the groove 94. Screw holes 104 can be provided in the anchor plate 70A for connecting the plates and screws 102. Thus, when the cable 75 is secured, the tension exerted on one end 96 of the cable is opposite to the tension on the other end 98, as illustrated by the arrows "T" in FIG. 6.

Returning once again to FIG. 4, it will now be apparent that the anchor plates 70A and 70B can be provided with a pawl 88 sized to engage either the screw assembly 84 with for a band mount, or the screw assembly 100 for a cable mount. To do this, the cable-shaped groove 94 can be aligned longitudinally within the track 76.

Thus, for efficient production of the bracket assembly 10, the halves of the anchor plate are formed with a first track for a first type of elongate connector, such a flat band, and a second track for a second type of connector having a shape different from the shape of the first type of elongate connector, such as a cable. The anchor plate can be provided with pinholes for connecting the ends of the bands at the blind end of each band track, as well as screw holes for the plates used to secure the cable in the second tracks. Where, as described here, the cable and the bands are attachable by means screw assemblies having the same size screws, a single pawl can be provided in the anchor plate for use with either screw assembly. Thus, a single mold can be used and all anchor plate halves can be machined identically to produce split clamp (female) members with anchor plates attachable alternately by either bands or cables. This not only reduces the cost of manufacturing, but simplifies parts identification and inventory management as well. When a customer order is received, the two identical female members are combined with a male member and the requested type of mast arm connector assembly.

Changes may be made in the combination and arrangement of the various parts, elements steps and procedures described herein without departing from the spirit and scope of the invention as defined in the following claims.

What is claimed is:

1. A bracket assembly for supporting a traffic control device on a support member, the bracket assembly comprising:

a male member having a tubular portion and a connecting portion, wherein the connecting portion is connectable to one of the traffic control device and the support member, and wherein the male member defines a throughbore extending through the tubular portion and the connecting portion; and a female member having a tubular portion and a connecting portion, wherein the connecting portion is connectable to the other one of the traffic control device and the support member, wherein the female member defines a throughbore extending through the connecting portion and the tubular portion, wherein the female member is divided longitudinally to form a pair of mating separate halves connectable to each other, and wherein the tubular portions of the mating halves are sized to clamp around the tubular portion of the male member.

2. The bracket assembly of claim 1 wherein the halves of the female member are provided with flanges having aligned bolt holes therein, and wherein the bracket assembly includes at least one bolt receivable in the bolt holes.

3. The bracket assembly of claim 2 wherein the connecting portion connectable to the traffic control device has an arcuate channel transverse to the longitudinal axis of the throughbore, wherein the traffic control device connecting portion further has flanges extending lateral to the arcuate channel, wherein each of the flanges has at least one bolt hole, and wherein the bracket assembly further comprises at least one U-bolt receivable in the bolt holes in the flanges of the traffic control device connecting portion.

4. The bracket assembly of claim 3 wherein the curved portion of the U-bolt is V-shaped.

5. The bracket assembly of claim 1 wherein the support member connecting portion has a channel sized to receive the support member.

6. The bracket assembly of claim 5 wherein the support member connecting portion comprises an anchor plate that defines the channel.

7. The bracket assembly of claim 6 further comprising at least one band attachable to the anchor plate.

8. The bracket assembly of claim 6 further comprising at least one cable attachable to the anchor plate.

9. The bracket assembly of claim 6 wherein the anchor plate is adapted for connection to a band and alternately to a cable.

10. The bracket assembly of claim 1 comprising an axial stop for retaining the tubular portion of the male member inside the tubular portion of the female member when the tubular portion of the female member is clamped around the tubular portion of the male member.

11. The bracket assembly of claim 10 wherein the tubular portion of the female member has a rear end, wherein the rear end of the tubular portion is provided with an annular shoulder, wherein the tubular portion of the male member has a front end, and wherein the axial stop comprises an annular flange on the front end shaped to engage the annular shoulder when the tubular portion of the female member is clamped around the tubular portion of the male member.

12. The bracket assembly of claim 10 wherein the tubular portion of the female member has a rear end, wherein the rear end of the tubular portion is provided with an annular shoulder, wherein the tubular portion of the male member has a front end, wherein the front end of the male member tubular portion has at least one screw hole, and wherein the axial stop comprises at least one screw in the screw hole long enough to engage the annular shoulder when the tubular portion of the female member is clamped around the tubular portion of the male member.

13. The bracket assembly of claim 10 wherein the tubular portion of the female member has a rear end, wherein the rear end of the tubular portion is provided with an annular shoulder, wherein the tubular portion of the male member has a front end, wherein the front end of the female member tubular portion has a circumferential groove, and wherein the axial stop comprises a snap ring sized to fit in the groove and to engage the annular shoulder when the tubular portion of the female member is clamped around the tubular portion of the male member.

14. The bracket assembly of claim 1 wherein the halves of the split female member are identically formed.

15. The bracket assembly of claim 14 wherein the connector portion of each half comprises a plate and wherein the plate is characterized by:

at least a first track sized to receive and align a portion of at least a first type of elongate connector; and an aperture sized to receive a connector attachment/adjustment assembly.

16. The bracket assembly of claim 15 further comprising a first type of elongate connector and a connector attachment/adjustment assembly.

17. The bracket assembly of claim 16 wherein the first type of elongate connector is a band, wherein one end of the band is attachable to the plate, wherein a portion of the band is disposable in the first track, wherein the connector attachment/adjustment assembly comprises a screw receivable in the aperture whereby the band can be tightened around the support member, whereby in the assembled bracket assembly tension on one band is in a direction opposite to the tension on the other band.

18. The bracket assembly of claim 16 wherein the first type of elongate connector is a cable, wherein a portion of the cable is disposable in the first track, wherein the connector attachment/adjustment assembly comprises a screw receivable in the aperture whereby the cable can be tightened around the support member, and whereby in the assembled bracket assembly tension on the cable on one half of the female member is in a direction opposite to the tension on the other half.

19. The bracket assembly of claim 18 wherein the cable is long enough to have one end attached to the screw in the aperture of each plate of the two halves of the female member, whereby in the assembled bracket assembly tension on one end of the cable is in a direction opposite to the tension on the other end of the cable, and wherein the bracket assembly further comprises means for securing a portion of the cable in the first track on each plate.

20. The bracket assembly of claim 15 wherein the plate is further characterized by a second track sized to receive and align a second type of elongate connector having a shape different from the shape of the first type of elongate connector.

21. The bracket assembly of claim 20 wherein the first track is sized to receive and align a band type connector and wherein the second track is sized to receive a cable type connector.

22. A bracket assembly for supporting a traffic control device on a support member, the bracket assembly comprising:

a first member having a tubular portion defining a throughbore;

means, having a throughbore, for removably and adjustably connecting the bracket assembly to the traffic control device;

a second member having a tubular portion defining a throughbore, and wherein the second member is divided longitudinally to form a pair of mating separate halves connectable to each other, and wherein the tubular portions of the mating halves are sized to clamp around the tubular portion of the first member;

means, having a throughbore, for removably and adjustably connecting the bracket assembly to the support member; and wherein the throughbores of the tubular portions of the first and second members are aligned with the throughbores of the support member connecting means and the traffic control device connecting means.

23. The bracket assembly of claim 22 wherein the halves of the second member are provided with flanges having aligned bolt holes therein, and wherein the assembly includes at least one bolt receivable in the bolt holes.

24. The bracket assembly of claim 23 wherein the traffic control device connecting means comprises an arcuate channel transverse to the longitudinal axis of the throughbores and flanges extending lateral to the arcuate channel, wherein each of the flanges has at least one bolt hole, and wherein the traffic control device connecting means further comprises at least one U-bolt receivable in the bolt holes in the flanges.

25. The bracket assembly of claim 24 wherein the curved portion of the U-bolt is V-shaped.

26. The bracket assembly of claim 22 wherein the support member connecting means comprises a channel sized to receive the support member.

27. The bracket assembly of claim 26 wherein the support member connecting means comprises an anchor plate that defines the channel.

28. The bracket assembly of claim 27 wherein the support member connecting means further comprises at least one band attachable to the anchor plate.

29. The bracket assembly of claim 27 wherein the support member connecting means further comprises at least one cable attachable to the anchor plate.

30. The bracket assembly of claim 27 wherein the anchor plate is adapted for connection to a band and alternately to a cable.

31. The bracket assembly of claim 22 further comprising means for securing the first member axially relative to the second member when the second member tubular portion is clamped around the tubular portion of the female member.

32. The bracket assembly of claim 31 wherein the tubular portion of the second member has a rear end, and wherein axial securing means comprises an axial shoulder formed in the rear end of the second member tubular portion and an axial flange on the front end of the tubular portion of the first member, the axial flange shaped to engage the annular shoulder when the tubular portion of the second member is clamped around the tubular portion of the first member.

33. The bracket assembly of claim 31 wherein the tubular portion of the second member has a rear end, wherein the tubular portion of the first member has a front end; and wherein axial securing means comprises an axial shoulder formed at the rear end of the second member tubular portion, at least one screw hole in front end of the first member tubular portion, and at least one screw receivable in the screw hole long enough to engage the annular shoulder when the tubular portion of the second member is clamped around the tubular portion of the first member.

34. The bracket assembly of claim 31 wherein the tubular portion of the second member has a rear end; wherein the tubular portion of the first member has a front end; and wherein the axial securing means includes an annular shoulder at the rear end of the second member tubular portion, a circumferential groove in the front end of the first member tubular portion, and a snap ring sized to fit in the groove and to engage the annular shoulder when the tubular portion of the second member is clamped around the tubular portion of the first member.

35. The bracket assembly of claim 22 wherein the halves of the second member are identically formed.

36. The bracket assembly of claim 35 wherein the support member connector means is attached to the second member and is likewise divided and identically formed, wherein each support member connecting means comprises a plate and at least a first elongate connector and a connector attachment/adjustment assembly, and wherein each plate is characterized by:

at least a first track sized to receive and align a portion of the first elongate connector; and an aperture sized to receive the connector attachment/adjustment assembly.

37. The bracket assembly of claim 36 wherein the first elongate connector is a band, wherein one end of the band is attachable to the plate, wherein a portion of the band is disposable in the first track, wherein the connector attachment/adjustment assembly comprises a screw receivable in the aperture whereby the band can be tightened around the support member, whereby in the assembled bracket assembly tension on one band is in a direction opposite to the tension on the other band.

38. The bracket assembly of claim 36 wherein the first elongate connector is a cable, wherein a portion of the cable is disposable in the first track, wherein the connector attachment/adjustment assembly comprises a screw receivable in the aperture whereby the cable can be tightened around the support member, wherein the assembled bracket assembly tension on the cable on one half of the second member is in a direction opposite to the tension on the cable on the other half.

39. The bracket assembly of claim 38 wherein the cable is long enough to have one end attached to the screw in the aperture of each plate of the two halves of the second member, whereby in the assembled bracket assembly tension on one end of the cable is in a direction opposite to the tension on the other end of the cable, and wherein the bracket assembly further comprises means for securing a portion of the cable in the track on each plate.

40. The bracket assembly of claim 36 wherein the plate is characterized by:

a first track sized to receive and align an elongate connector of a first type;

a second track sized to receive and align an elongate connector of a second type having a shape different from the shape of the first type of elongate connector; and an aperture sized to receive a connector attachment/adjustment assembly.

41. The bracket assembly of claim 40 wherein the first type of elongate connector is a band type connector and wherein the second type of connector is a cable type connector.

42. A bracket assembly for supporting a traffic control device on a mast arm, the bracket assembly comprising:

a male member comprising a tubular portion with a front end and rear end and defining a throughbore;

a female member comprising a tubular portion having a rear end and defining a throughbore;

wherein the female member is divided longitudinally to form a pair of mating separate halves connectable to each other, and wherein the tubular portions of the mating halves are sized to clamp around the tubular portion of the male member; a clamp plate having a throughbore;

a connector assembly for removably and adjustably connecting the clamp plate to the traffic control device;

an anchor plate having a throughbore; a connector assembly for removably and adjustably connecting the anchor plate to the mast arm; and wherein the throughbores of the male and female members, the clamp plate and the anchor plate all are coaxially aligned.

43. The bracket assembly of claim 42 wherein the halves of the female member are provided with flanges having aligned bolt holes therein, and wherein the bracket assembly includes at least one bolt receivable in the bolt holes.

44. The bracket assembly of claim 43 wherein the clamp plate comprises an arcuate channel flanked by laterally extending flanges with bolt holes therein, and wherein clamp plate connector assembly comprises at least one U-bolt receivable in the bolt holes in the flanges of the clamp plate.

45. The bracket assembly of claim 44 wherein the curved portion of the U-bolt is V-shaped.

46. The bracket assembly of claim 42 wherein the anchor plate defines a channel sized to receive the mast arm.

47. The bracket assembly of claim 42 wherein the anchor plate connector assembly comprises at least one band attachable to the anchor plate.

48. The bracket assembly of claim 42 wherein the anchor plate connector assembly comprises at least one cable attachable to the anchor plate.

49. The bracket assembly of claim 42 wherein the anchor plate is adapted for connection to a band and alternately to a cable.

50. The bracket assembly of claim 42 further comprising means for securing the male member axially relative to the female member when the female member tubular portion is clamped around the tubular portion of the male member.

51. The bracket assembly of claim 50 wherein axial securing means comprises an axial shoulder formed in the rear end of the female member tubular portion and an axial flange on the front end of the male member tubular portion, the axial flange being shaped to engage the annular shoulder when the tubular portion of the female member is clamped around the tubular portion of the male member.

52. The bracket assembly of claim 50 wherein axial securing means comprises an axial shoulder formed at the rear end of the female member tubular portion, at least one screw hole in the front end of the male member tubular portion, and at least one screw receivable in the screw hole long enough to engage the annular shoulder when the female member is clamped around the male member.

53. The bracket assembly of claim 50 wherein the axial securing means includes an annular shoulder at the rear end of the female member tubular portion, a circumferential groove in the front end of the male member tubular portion, and a snap ring sized to fit in the groove and to engage the annular shoulder when the tubular portion of the female member is clamped around the tubular portion of the male member.

54. The bracket assembly of claim 42 wherein the clamp plate is attached to the male member and the anchor plate is attached to the female member.

55. The bracket assembly of claim 54 wherein the clamp plate is integrally formed with the male member and the anchor plate is integrally formed with the female member.

56. The bracket assembly of claim 42 wherein anchor plate is attached to the female member and is likewise divided, and wherein the halves of the female member/anchor plate are identically formed.

57. The bracket assembly of claim 56 wherein the mast arm connector assembly comprises an elongate connector of a first type, and wherein the anchor plate is characterized by:

at least a first track sized to receive and align a portion of the first type elongate connector; and an aperture sized to receive a connector attachment/adjustment assembly.

58. The bracket assembly of claim 57 wherein the elongate connector of the first type is a band type connector, wherein one end of the band is attachable to the plate, wherein a portion of the band is disposable in the first track, wherein the connector attachment/adjustment assembly comprises a screw receivable in the aperture whereby the band can be tightened around the mast arm, and whereby in the assembled bracket assembly tension on one band on one half of the anchor plate is in a direction opposite to the tension on the other half.

59. The bracket assembly of claim 57 wherein the first type of elongate connector is a cable type connector, wherein a portion of the cable is disposable in the first track, wherein the connector attachment/adjustment assembly comprises a screw receivable in the aperture whereby the cable can be tightened around the mast arm, and whereby in the assembled bracket assembly tension on the cable on one half of the anchor plate is in a direction opposite to the tension on the other half.

60. The bracket assembly of claim 59 wherein the cable is long enough to have one end attached to the screw in the aperture of each plate of the two halves of the female member whereby in the assembled bracket assembly tension on one end of the cable is in a direction opposite to the tension on the other end of the cable, and wherein the bracket assembly further comprises means for securing a portion of the cable in the track on each plate.

61. The bracket assembly of claim 57 wherein the anchor plate is further characterized by a second track sized to receive and align an elongate connector of a second type and having a shape different from the first type of elongate connector.

62. The bracket assembly of claim 56 wherein the mast arm connector assembly comprises an elongate connector of either a first type or a second type, and wherein the anchor plate is characterized by:

a first track sized to receive and align a portion of the first type elongate connector;

a second track sized to receive and align a portion of the second type elongate connector; and an aperture sized to receive a connector attachment/adjustment assembly.

63. The bracket assembly of claim 62 wherein the first type of elongate connector is a band type connector and the second type of elongate connector is a cable type connector.

64. A bracket assembly for supporting a traffic control device on a support member, the bracket assembly comprising:

a first member having a coupling portion defining a wiring passageway therethrough;

a second member having a coupling portion defining a wiring passageway therethrough, the coupling portion being divided longitudinally to form at least two separate sections connectable to each other, wherein the at least two sections of the coupling portion are sized to clamp around the coupling portion of the first member;

a first connector, having a wiring passageway therethrough, for connecting the bracket assembly to the support member;

a second connector, having a wiring passageway therethrough, for connecting the bracket assembly to the traffic control device; and wherein the wiring passageways of the coupling portions of the first and second members communicate with the wiring passageways of the first and second connectors to form a continuous wiring path through the bracket assembly.

65. A bracket assembly for supporting an object on a support member, the bracket assembly comprising:

a first member having a coupling portion defining a passageway extending therethrough;

a second member having a coupling portion defining a passageway therethrough, the coupling portion being divided longitudinally to form two sections connectable to each other, wherein the two separate sections of the coupling portion are sized to clamp around the coupling portion of the first member;

a first connector, having a passageway therethrough, for connecting the bracket assembly to the support member;

a second connector, having a passageway therethrough, for connecting the bracket assembly to the object; and wherein the passageways of the coupling portions of the first and second members communicate with the passageways of the first and second connectors to form a continuous passageway through the bracket assembly.

* * * * *